US012624930B2

(12) United States Patent
Larsen

(10) Patent No.: US 12,624,930 B2
(45) Date of Patent: May 12, 2026

(54) SPORTS SHOOTING TARGET AND A LAUNCHING HEAD AND CORRESPONDING DEVICE

(71) Applicant: NORDIC SPORTING CLAYS APS, Copenhagen K (DK)

(72) Inventor: Jens Larsen, Græsted (DK)

(73) Assignee: NORDIC SPORTING CLAYS APS, Copenhagen K (DK)

( * ) Notice: Subject to any disclaimer, the term of this patent is extended or adjusted under 35 U.S.C. 154(b) by 185 days.

(21) Appl. No.: 18/576,559

(22) PCT Filed: Jun. 30, 2022

(86) PCT No.: PCT/DK2022/000155

§ 371 (c)(1),
(2) Date: Jan. 4, 2024

(87) PCT Pub. No.: WO2023/280358

PCT Pub. Date: Jan. 12, 2023

(65) Prior Publication Data

US 2024/0369330 A1 Nov. 7, 2024

(30) Foreign Application Priority Data

Jul. 5, 2021 (EP) ..... 21020349

(51) Int. Cl.
*F41J 9/18* (2006.01)

(52) U.S. Cl.
CPC ..... *F41J 9/18* (2013.01)

(58) Field of Classification Search
CPC . F41J 9/16; F41J 9/18; F41J 9/32; F41J 1/01; A63H 27/00; A63H 33/18; A63B 67/06; A63B 67/16
USPC ..... 124/1, 6, 8, 41.1; 473/588, 589; 446/46, 446/48
See application file for complete search history.

(56) References Cited

U.S. PATENT DOCUMENTS 3,130,717 A * 4/1964 Moinil ..... F41J 9/18 124/1
3,394,906 A * 7/1968 Rogers ..... B64C 29/0025 446/37
3,605,328 A * 9/1971 Kilroy, Jr. ..... A63H 27/14 124/16

(Continued)

FOREIGN PATENT DOCUMENTS

EP 1519137 A1 * 3/2005 ..... F41J 9/32
EP 3279604 A1 * 2/2018 ..... F41J 9/18
WO WO-2020253923 A1 * 12/2020 ..... F41J 9/32

*Primary Examiner* — Alexander R Niconovich
(74) *Attorney, Agent, or Firm* — Jacob M. Ward; Ward Law Office LLC

(57) ABSTRACT

A launching head for launching two or more sports shooting targets is provided, where each target is of a generally disc-shaped configuration. The launching head is of a generally tubular configuration defined by a longitudinally extending rotational axis and includes an outer circumferential support surface portion formed to fit into and support the respective targets. The launching head is provided with a plurality of retaining claw members configured to be able to pivot in a plane containing the longitudinal axis and pivot an angle relative to a plane extending perpendicularly to the longitudinal axis. A launching device applying the launching head to a sports shooting target is also provided.

15 Claims, 9 Drawing Sheets

(56) References Cited

U.S. PATENT DOCUMENTS 3,742,643 A * 7/1973 Keith ..... A63H 27/12 446/46
3,838,835 A * 10/1974 Kling ..... B64U 30/26 416/129
4,205,651 A * 6/1980 Lante-Montefeltro Della Rovere ..... F41J 9/18 116/303
4,508,093 A * 4/1985 Bertini ..... F41J 9/18 124/32
5,030,157 A * 7/1991 Silverglate ..... A63H 33/18 446/36
5,348,509 A * 9/1994 Riccardi ..... A63H 33/18 446/475
5,967,521 A * 10/1999 Hellings ..... A01K 39/0106 273/363
6,733,356 B2 * 5/2004 Lee ..... A63H 27/14 124/31
6,758,203 B1 * 7/2004 Wu ..... F41J 9/30 446/45
7,832,561 B2 * 11/2010 Polk, III ..... F41F 7/00 206/471
8,608,598 B2 * 12/2013 Hoang ..... A63H 33/18 473/590
10,619,979 B2 * 4/2020 Francez ..... F41J 9/18
12,163,768 B2 * 12/2024 Larsen ..... F41J 9/30
12,313,372 B2 * 5/2025 Wolfinbarger ..... F41B 7/006
2002/0098768 A1 * 7/2002 Kuo ..... A63H 27/14 446/40
2003/0119415 A1 * 6/2003 Kaisio ..... A63H 27/12 446/46
2008/0153381 A1 * 6/2008 Schenk ..... A63H 27/12 446/40
2009/0013983 A1 * 1/2009 Polk, III ..... A63H 27/14 124/6
2012/0187630 A1 * 7/2012 Barzee ..... F41J 9/16 264/239
2014/0070493 A1 * 3/2014 Gonzalez ..... A63B 67/06 473/588
2022/0178661 A1 * 6/2022 Larsen ..... F41J 1/01
2024/0361106 A1 * 10/2024 Larsen ..... F41J 9/18

* cited by examiner

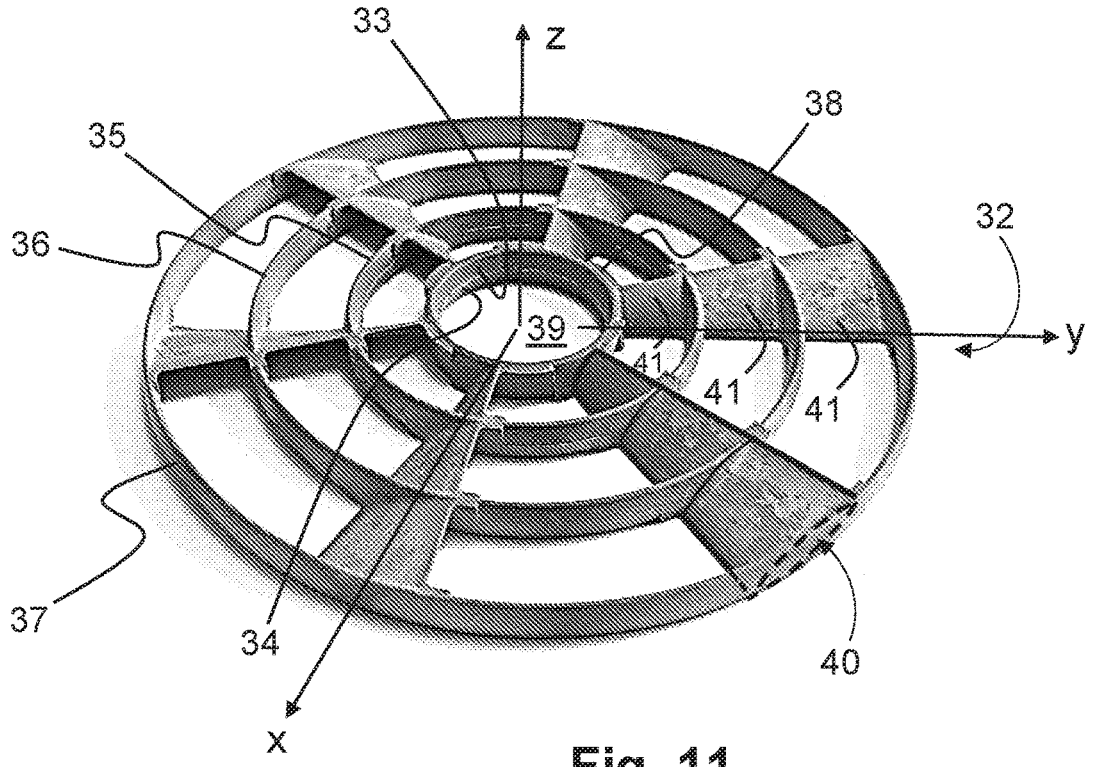
Fig. 11
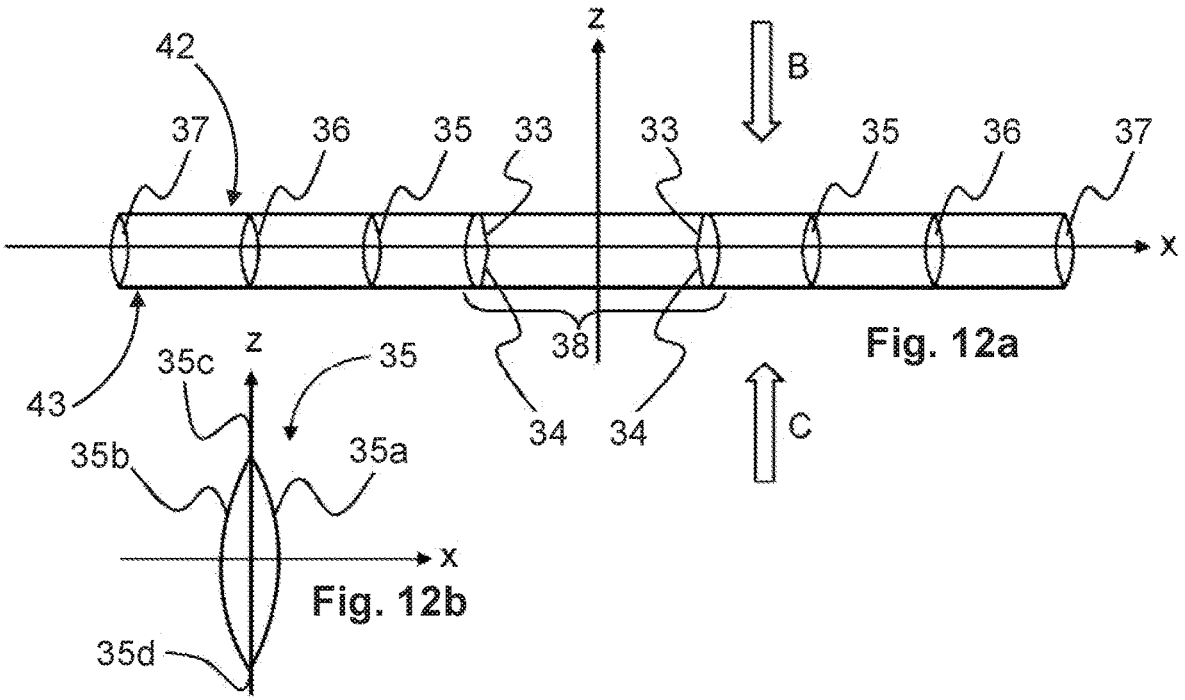
Fig. 12a
Fig. 12b
Fig. 12

SPORTS SHOOTING TARGET AND A LAUNCHING HEAD AND CORRESPONDING DEVICE

CROSS-REFERENCE TO RELATED APPLICATIONS

This patent application is a United States National Stage of International Patent Application No. PCT/DK2022/000155, filed Jun. 30, 2022, which in turn claims the benefit of European Patent Application 210200349.3, filed Jul. 5, 2021. The entire disclosures of the above applications are incorporated herein by reference.

TECHNICAL FIELD

The present invention relates to the field of sports shooting targets and devices or apparatuses for launching sports shooting targets and more particularly to the launching heads of such devices or apparatuses.

BACKGROUND OF THE INVENTION

Traditional prior art launching apparatuses comprise a throwing arm that can be rotated about a rotational axis and onto which a sports shooting target is provided from a supply container at a distance from the rotational axis of the throwing arm. Longitudinally opposite the rotational axis, the throwing arm has a free end portion from which a target provided on the arm will be launched due to the centrifugal force exerted on the target by the rotation of the throwing arm.

A prior art sports shooting target and launching apparatus is described in WO2020/253923A1. The launching apparatus described herein comprises a launching head designed to accommodate and launch a single sports shooting target. However, when shooting with a double barrel shotgun or hunting rifle, there is a need for a launching apparatus that can launch two sports shooting targets immediately after each other, such that the shooter can aim at one target first and immediately thereafter at the second target. This need is met by the launching head and device according to the present invention.

OBJECTS OF THE INVENTION

On the above background it is an object of the present invention to provide a launching head and a device in which this launching head is incorporated that makes it possible to launch two—or even more—sports shooting targets from the same launching head without having to reload the launching head between two consecutive launching of sport shooting targets.

It is a further object of the invention to provide a launching head and corresponding device that ensures that a very light and fragile target can be launched from the launching head in an optimal manner without the risk of damaging the target during the launching process.

The launching head and device of the present invention is especially suited for the sports shooting targets according to the present invention but also for targets of the configurations described in the above-mentioned prior art document WO2020/253923A1. It is furthermore understood that also targets that are configured differently can be used with the launching head and device of the present invention, provided the hub portion of the target and the corresponding portion of the launching head can be coupled to each other to render a reliable and safe coupling between these parts.

It is a further object of the present invention to provide a sports shooting target that can be applied to the launching head of the invention from either the top face of the target or from the bottom face of the target, such that a user does not have to consider whether he is applying the target to the launching head in the correct way. This will both be advantageous in the case where the user is loading the launching head with targets on site, but also when containers adapted for containing a plurality of targets are loaded with targets, which containers can be applied to the launching head or devices according to the present invention.

DISCLOSURE OF THE INVENTION

The above and further objects and advantages are according to a first aspect of the present invention provided by a launching head for launching two or more sports shooting targets, where each target is of a generally disc-shaped configuration, where the target is defined by a rotational axis and a central hub portion extending perpendicularly to the rotational axis, which hub portion comprises a radially inward facing surface formed for releasable attachment of the targets to the launching head (10), wherein:

- the launching head is of a generally tubular configuration defined by a longitudinally extending rotational axis z and where the launching head is provided with an outer circumferential support surface portion formed to fit into and support said radially inward facing surface of the hub portion of the respective targets;
- the launching head is provided with a plurality of retaining claw members configured to be able to pivot in a plane containing the longitudinally extending rotational axis z and pivot an angle $\alpha$ relative to a plane (x, y) extending perpendicularly to the longitudinally extending rotational axis z;
- where each of the retaining claw members is provided with two longitudinally spaced-apart retaining portions configured such that:
- when the retaining claw member is in a first pivotal position $\alpha=\alpha_1$, both of the retaining portions are in a radial position outside the support surface portion, in which position they attach the hub portion of the respective targets to the support surface portion of the launching head, and
- when the retaining claw member is in a second pivotal position $\alpha=\alpha_2$, the retaining portion closest to the pivot point is at a radial position outside the support surface portion, in which position it attaches the corresponding target to the launching head, whereas the other retaining portion is at a radial position inside the support surface portion, in which position it does not attach the corresponding target to the launching head, and
- when the retaining claw member is in a third pivotal position $\alpha=\alpha_3$, both of the retaining portions are in a radial position inside the support surface portion where they do not attach the respective target to the support surface of the launching head.

In an embodiment of the first aspect, the outer circumferential surface portion extends in parallel with the longitudinal axis thereby forming a cylindrical support surface portion about the longitudinal axis, which cylindrical support surface portion is configured to guide and support the targets during launching of the targets from the launching head.

In an embodiment of the first aspect, the outer circumferential support surface is totally or in part formed by the outer circumferential surface of a cap member which cap member is provided at the longitudinal end portion of the outer body portion that faces in the positive direction of the longitudinal rotational axis z.

In an embodiment of the first aspect, the launching head comprises an inner body portion and an outer body portion that can undergo a longitudinal displacement relative to the inner body portion, where the retaining claw members are in engagement with the inner body portion and the outer body portion such that said displacement causes the retaining claw members to pivot in a plane containing the longitudinally extending rotational axis z between said first, second and third pivotal positions.

In an embodiment of the first aspect, the retaining claw members each comprises two retaining contact portions configured to establish contact with and retain a respective target to the launching head.

In an embodiment of the first aspect, each of the retaining claw members comprises extensions, where one extension is configured to fit into a corresponding circumferentially extending groove provided in the inner body portion and the second extension of the retaining claw member is configured to fit into a corresponding groove on an inner surface portion of the outer body portion, whereby a longitudinal displacement of the outer body portion relative to the inner body portion causes the retaining claw member to pivot an angle in a plane comprising the longitudinal rotational axis z of the launching head.

In an embodiment of the first aspect, each of the retaining claw members is divided in an upper body portion and a lower body portion separated by line L that extends substantially through the center portions of the two extensions of the claw member and where the geometrical configuration of the claw member is such that the center of gravity of the claw member is located either on the line L or within the lower body portion of the claw member.

In an embodiment of the first aspect, the longitudinally spaced-apart retaining portions of the claw member have contact faces that correspond to the corresponding inner circumferential surface of the hub portion of the corresponding target.

The above and further objects and advantages are according to a second aspect of the present invention provided by launching device comprising a launching head according to the first aspect, where the launching device comprises displacement means configured to displace the outer body portion relative to the inner body portion of the launching head such that the displacement can be preadjusted in such a manner that a given desired time interval between the launching of the first target from the launching head and the launching of the second target from the launching head is obtained.

In an embodiment of the second aspect, the displacement means comprises longitudinally extending rod members that connects the outer body portion of the launching head with displacement drive means configured to provide such a displacement of the outer body portion that is required to pivot the retaining claw members from one extreme position in which both targets are retained to the launching head, and hence rotates in unison with the launching head to an opposite extreme position in which both targets are released from the launching head.

In an embodiment of the second aspect, the displacement means are configured and controlled such that the displacement is continuous.

In an embodiment of the second aspect, the displacement means are configured and controlled such that the displacement is stepwise.

The above and further objects and advantages are according to a third aspect of the present invention provided by a sports shooting target for application with the launching head according to the first aspect of the invention and the launching device according to the second aspect of the application, where the target is made of a biodegradable material, the target having a rotational axis z and attachment means configured for releasable attachment of the target to the launching head according to the first aspect, where the target is provided with trajectory stabilizing means that are configured to stabilize the trajectory of the target by gyro effect caused by rotation about the rotational axis z, which stabilizing means further function as propelling means that cause forward movement of the target along its trajectory due to the rotation about said rotational axis z, when the target is rotating, where the stabilizing means comprises fan means comprising fan blades that rotates in unison with the target, when the target rotates, such that the stabilizing means both provides the stabilizing gyro effect and forward propulsion (movement) of the target along a chosen trajectory; where:

- the sports shooting target comprises a hub portion configured for releasable attachment to a corresponding portion of the launching head according to the first aspect, which portion of the launching head, when the target is attached to it, can rotate the target and release it from the launching head, when a desired terminal rotational speed has been reached; and
- the hub portion is provided with an inner circumferential surface facilitating release of the target from the above-mentioned portion of the launching head and which surface defines an inner space;
- the target comprises a plurality of concentric ring members arranged about the rotational axis z of the target at different distances from the rotational axis z and outside the hub portion;
- the stabilizing means comprises a plurality of fan blades that extend radially from the hub portion to the ring member provided at the largest distance from the rotational axis z; and
- where the hub portion comprises inwardly sloping surfaces that converge towards the longitudinal rotational axis z of the target, where the inwardly sloping surfaces of the hub portion are substantially mirror-symmetrical about a (x, y) plane extending centrally through the target (i.e. at approximately the same distance from the upper and lower surfaces of the essentially disc-shaped target) and perpendicularly to the rotational axis z of the target, whereby it becomes possible to attach the hob portion of the target to the launching head from either the upper or lower side of the target.

In an embodiment of the third aspect, the ring members have cross-sectional shapes comprising curved first and second side faces, where the first and second side faces meet at a substantially sharp edge portion, thereby optimizing the aero-dynamic properties of the respective ring members.

In an embodiment of the third aspect, the inclination angle of the fan members relative to the (x, y) plane of the target increases towards the hub portion.

BRIEF DESCRIPTION OF THE DRAWINGS

Further benefits and advantages of the present invention will become apparent after reading the detailed description of non-limiting exemplary embodiments of the invention in conjunction with the accompanying drawings, wherein

FIG. 11 shows a perspective view of a sports shooting target according to an embodiment of the invention; and FIGS. 12(*a*) and 12(*b*) show a schematic side view of the embodiment of a sports shooting target according to the invention shown in FIG. 11.

DETAILED DESCRIPTION OF THE INVENTION

The principles of the invention will be illustrated by various embodiments hereof. It is however understood that a person skilled in the art may conceive other embodiments than those shown and described in the detailed description of the invention and that the scope of the invention is defined by the independent claims.

Figure 1:
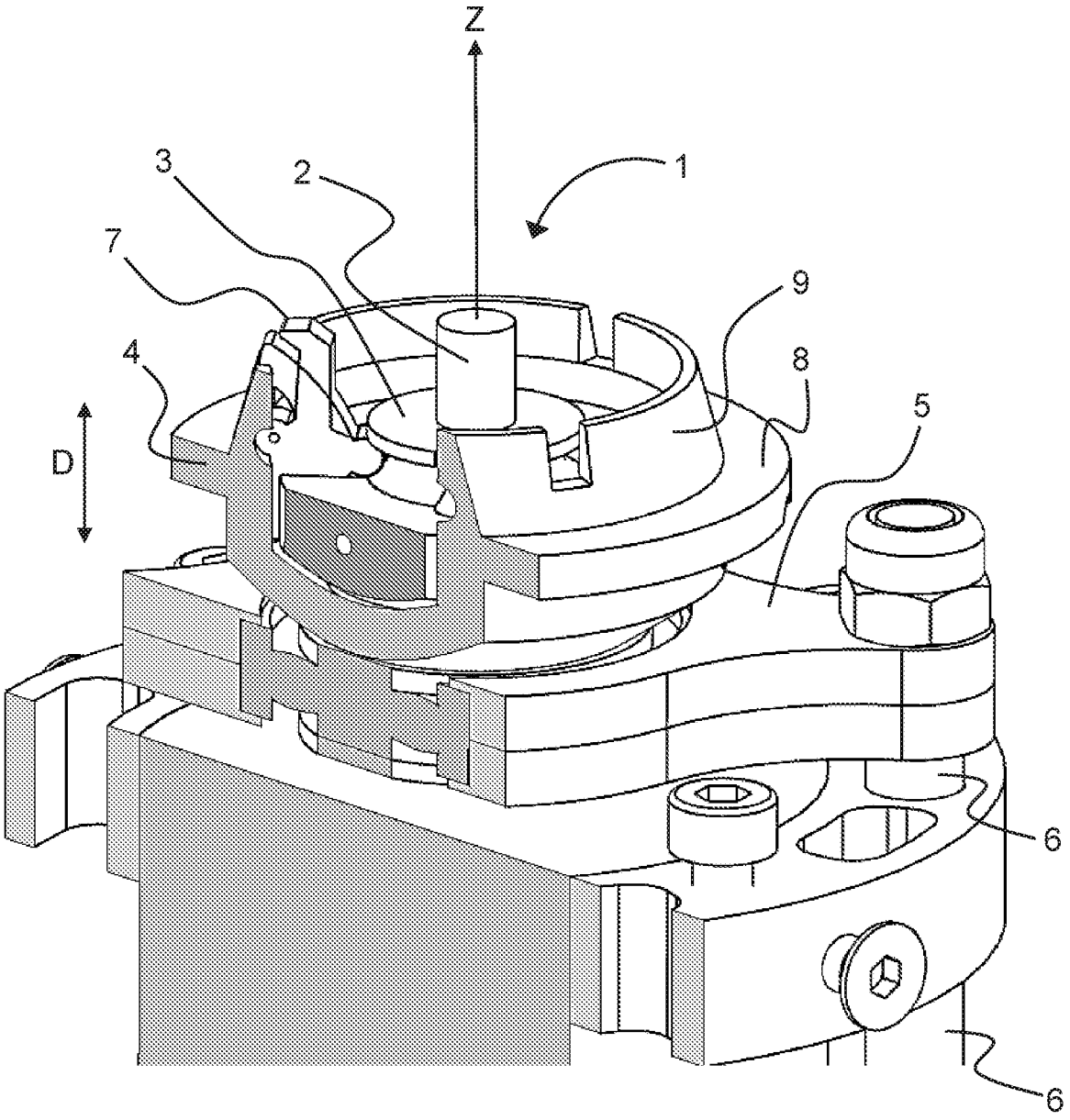
Fig. 1 Prior art
FIG. 1 shows a schematic perspective view of a prior art launching head.

With reference to FIG. 1 there is shown a prior art launching head designed to accommodate and launch a single sports shooting target. This launching head and the associated launching apparatus is described in detail in WO2020/253923A1.

The prior art launching head shown in FIG. 1 generally indicated by reference numeral 1 comprises a central portion 2, 3 located at a fixed position along the longitudinal axis Z through the launching head. Surrounding this central portion 2, 3 there is provided a longitudinally displaceable portion, a cross section of which is indicated by 4 in FIG. 1. This portion is mounted on a yoke 5 connected with a longitudinally extending drive rod 6 attached to a motor or actuator mechanism (not shown in FIG. 1) that is configured such that it can displace the displaceable portion 4 along the longitudinal axis Z and hence relative to the central portion 2, 3. This displacement is indicated by arrow D in FIG. 1.

When using the prior art launching apparatus, the hub portion of a sports shooting target is placed such that it is supported by the circumferential surface 8 and in contact with the conical surface portion 9 of the displaceable portion of the launching head. Initially, the displaceable portion 4 is displaced downwards (as seen in FIG. 1), which makes the retaining claws 7 (only one of these is shown in FIG. 1) pivot radially outward to a position, in which it retains the hub portion of the target in place on the launching head. The launching head is then rotated and when the required final rotational speed has been obtained, the displaceable portion 4 is displaced longitudinally upward (in the positive z-direction), whereby the claws 7 release their grip on the hub portion of the target, such that it is launched in the direction of the positive z-axis.

Figure 2:
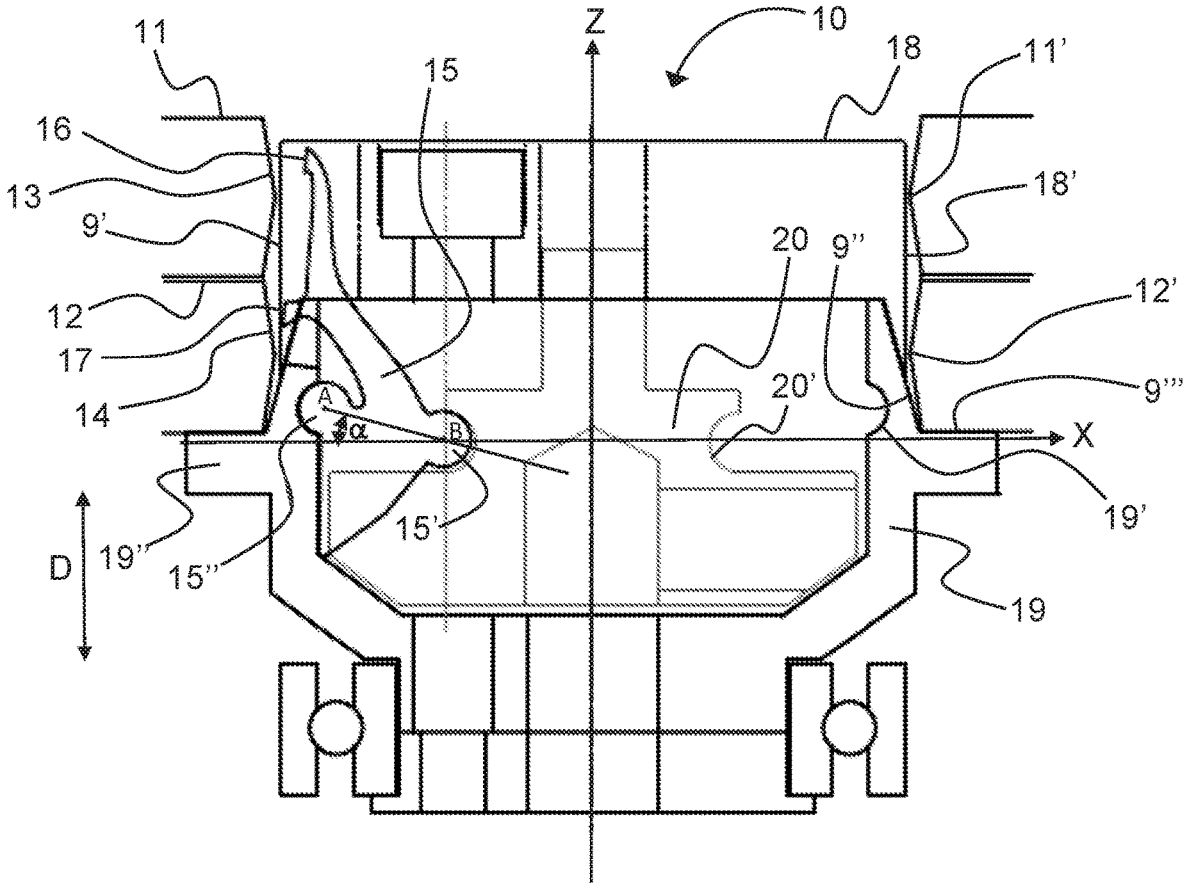
FIG. 2 shows a schematic view of an embodiment of a launching head for two sports shooting targets according to the present invention.

With reference to FIG. 2 there is shown an embodiment of a launching head according to the present invention, which launching head 10 is configured to accommodate and launch two sports shooting targets 11, 12 of a design that is described in detail in WO2020/253923A1. It is however understood that other sports shooting targets than those described in the above-mentioned International application can also be used in the launching head of the present invention, provided such targets have hub portions that correspond to the launching head according to the present invention.

The launching head shown in FIG. 2 is of a generally tubular shape (see also FIGS. 7, 8 and 9) centered about a longitudinally extending rotational axis z. It comprises a central inner body portion 20 that is provided at a fixed position along the longitudinal axis z and a longitudinally displaceable outer body portion 19 that can undergo a longitudinal displacement relative to the inner body portion 20 as indicated by arrow D.

In the prior art launching head shown in FIG. 1, a target positioned on the launching head is supported by the conical surface portion 9. In a preferred embodiment of the launching head according to the present invention this conical support surface portion 9 is replaced by a support portion 9', 9", 9'" where the portion 9' is cylindrical with the longitudinal axis z as symmetry axis. The support surface portion 9" is conical such that it corresponds to the inclined inner hub surface 14 of the lower target 14, which target additionally rests on the surface portion 9'". It is also possible entirely to omit portion 9", such that portions 9' and 9'" meet at an angle substantially equal to 90 degrees. The important feature of the support surface is that the radially innermost regions 11' and 12' of the targets remains in contact with the support surface 9' as long as the targets during the launching process are within the longitudinal extension of the launching head. As mentioned before, this prevents wobbling of the target during the launching process and thereby increases the range of the launching head as well as minimizing the risk of damage to the targets during the launching process.

The launching head of the invention comprises a plurality of retaining claw members 15 provided with extensions 15' and 15". Extension 15' is configures to fit into a corresponding circumferentially extending groove 20' provided in the inner body portion 20 with the effect that extension 15' is in a fixed relationship to the longitudinal axis z. The second extension 15" of the retaining claw member 15 is configured to fit into a corresponding groove 19' on the inner surface portion of the outer body portion 19. Thus, when the outer body portion 19 undergoes a longitudinal displacement D relative to the inner body portion 20, the retaining claw member 15 pivots an angle α relative to the (x, y) plane about point B, as shown in FIG. 2.

Figure 9:
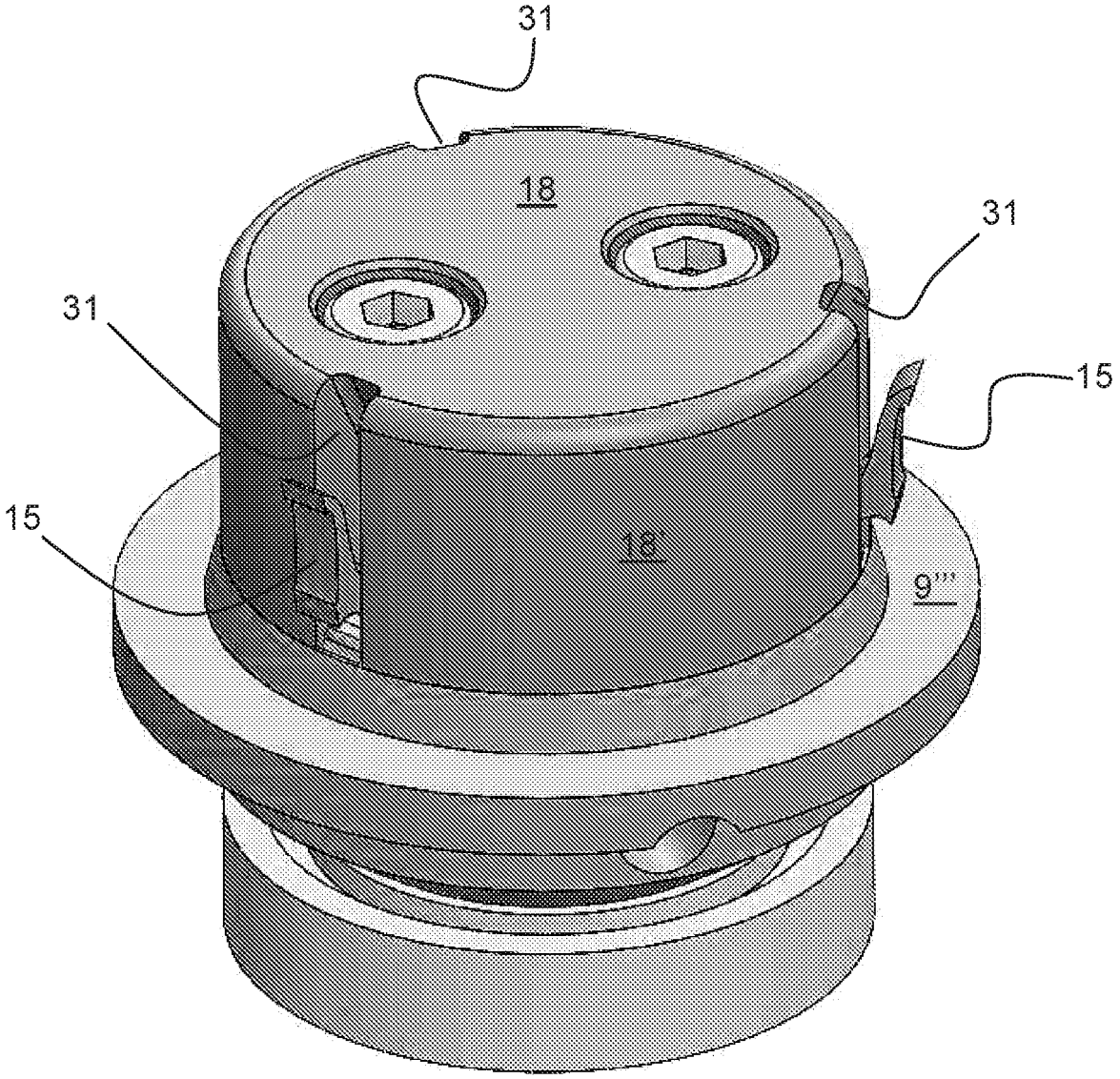
FIG. 9 shows a perspective vies of a launching head according to an embodiment of the invention comprising three retaining claw members.

Only one of the retaining claw members 15 is shown in FIG. 2, but typically three such retaining claw members are provided in the launching head, angularly equally distributed circumferentially on the launching head as shown in FIG. 9. The function of the retaining claw members is to retain the targets 11, 12 to the launching head until it retains a rotational speed that is required for launching of the targets.

Each of the retaining claw members 15 is provided with two retaining contact portions 16, 17 configured to establish contact with and retain the respective target 11, 12 to the launching head. More specifically, the retaining contact portion 16 is configured to releasably contact the inclined hub portion 13 of the upper target 11 (as seen in FIG. 2) and the retaining contact portion 17 is configured to releasably contact the inclined hub portion 14 of the lower target 11 (as seen in FIG. 2). The functioning of the retaining claw members 15 will be described in the following with respect to FIGS. 3 through 9.

In the embodiment of the launching head 10 of the invention, the outer body portion 19 is on top of it (in the positive z-direction) provided with a cap 18 with longitudinally extending circumferential slits that allow the respective claw member 15 to pivot between positions in which the retaining contact portions 16, 17 are situated radially outside the cap 18 to form contact with the respective targets 11, 12 and positions in which the respective claw members 15 are situated entirely inside the cap 18. In a preferred embodiment, the cap 18 is of a cylindrical shape with a symmetry axis coinciding the longitudinally extending rotational axis z of the launching head 10, i.e., the outer circumferential surface 18' of the cap 18 against which the inner portion 11' and 12' of the hubs of the targets 11 and 12, respectively rests, extends in the direction of the z-axis. This has the very advantageous effect that the target during launching from the launching head (i.e. after release of the target from the retaining claw members) is forced to undergo a longitudinal displacement along the outer circumferential surface 18' of the cap 18 that is parallel with the longitudinal axis z, thereby preventing a wobbling movement of the target during launching, which wobbling movement would reduce longitudinal and rotational speed of the target (and hence the range of the launching head) and even prove hazardous to the target.

Figure 3:
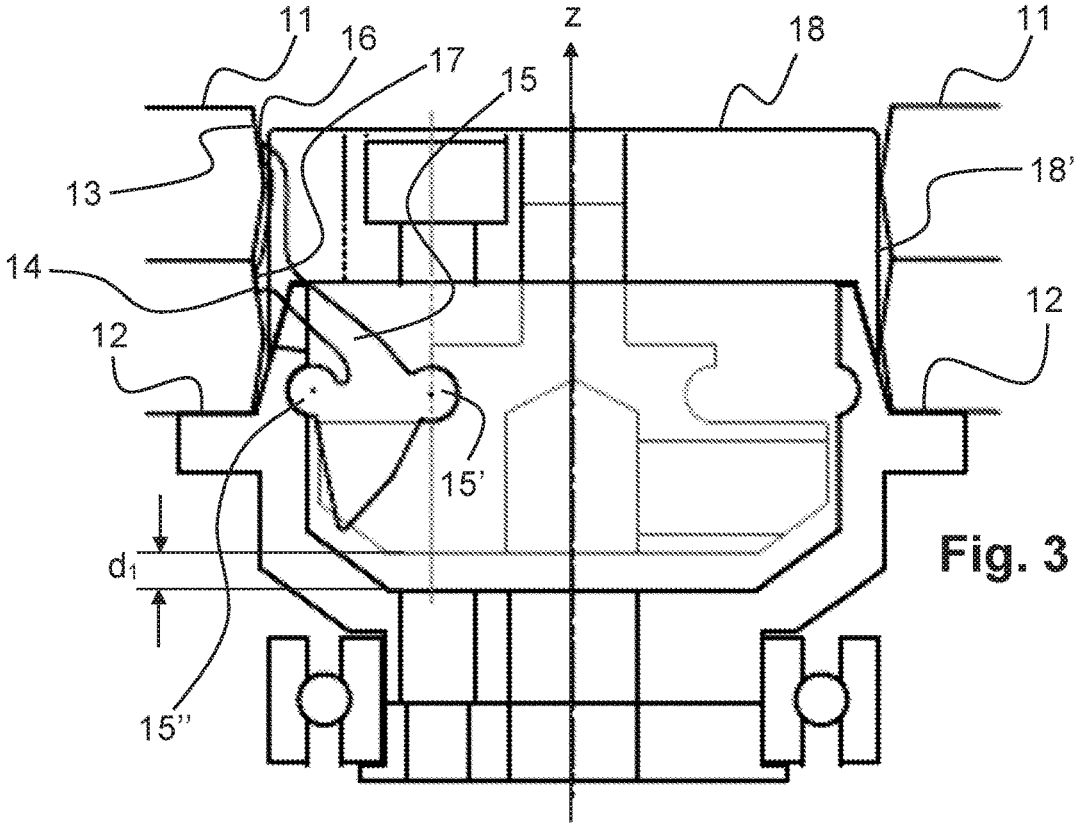
FIG. 3 shows a schematic view of the embodiment of FIG. 2 with the retaining claw member in a position in which it fixes the hub portions of both sports shooting targets to the launching head.
Figure 4:
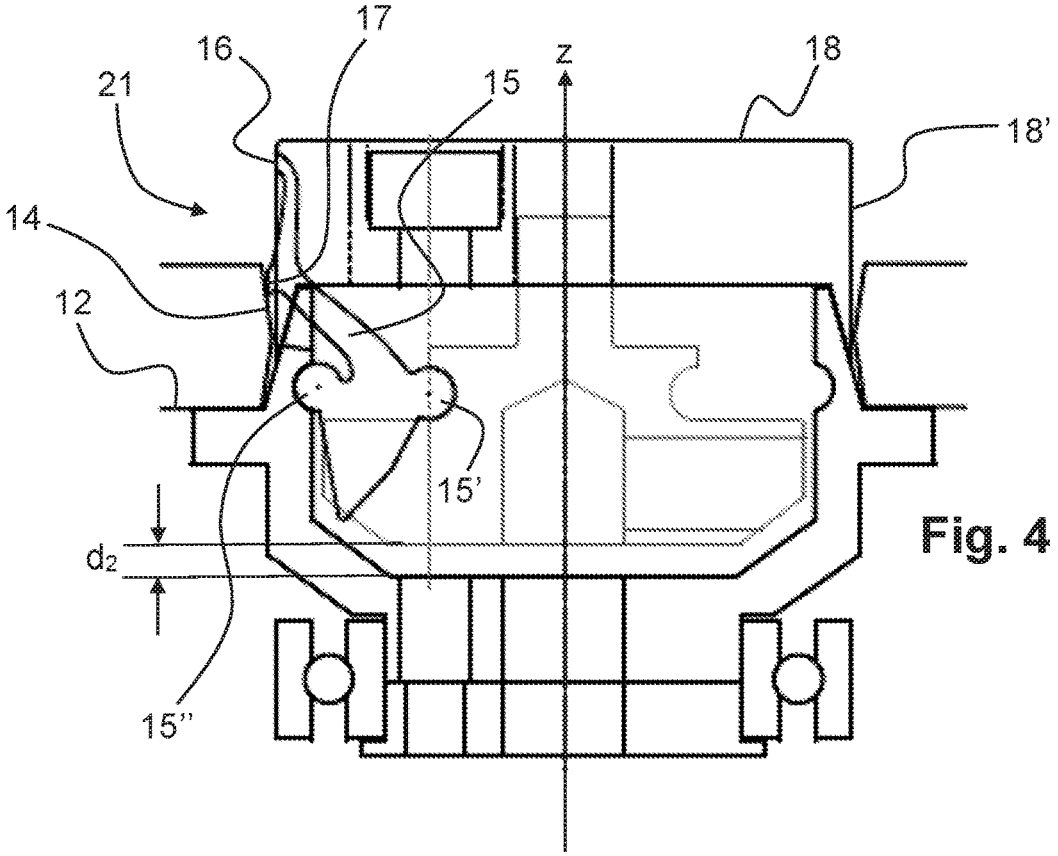
FIG. 4 shows a schematic view of the embodiment of FIG. 2 with the retaining claw member in a position in which it has released the upper sports shooting target from the launching head and still fixes the hub portion of the lower sports shooting targets to the launching head.
Figure 5:
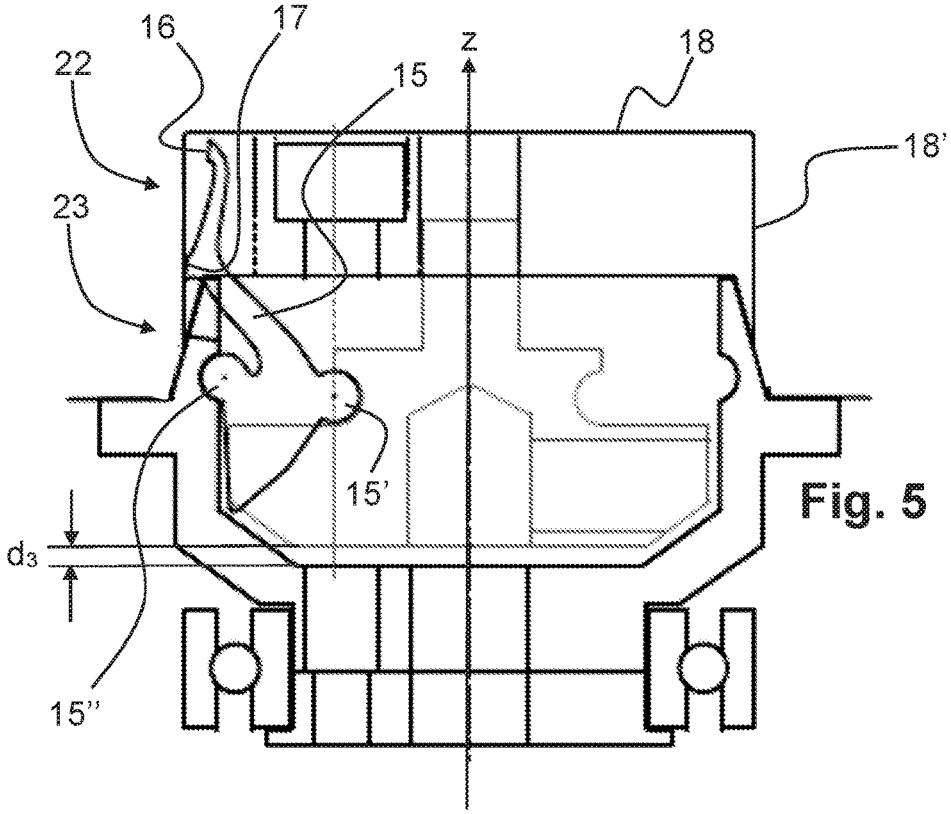
FIG. 5 shows a schematic view of the embodiment of FIG. 2 with the retaining claw member in a position in which it releases the hub portion of the lower sports shooting targets from the launching head.

With reference to FIGS. 3, 4 and 5 there is shown the pivotal position of one of the claw members 15 in three states during a launching process.

In the state shown in FIG. 3, the two contact faces 16 and 17 of the retaining claw member 15 have contact with both the upper target 11 and the lower target 12 and hence fixes the targets 11, 12 to the launching head. In this state the launching head undergoes rotational acceleration until a desired final rotational speed is obtained. When this rotational speed is obtained, the outer body portion 19 of the launching head undergoes an upward displacement (in the positive direction of the z-axis) relative to the inner body portion 20. This displacement causes the claw member 15 to pivot about the extension 15' that is in fixed relationship to the inner body portion 20, whereby the upper contact face 16 of the claw member 15 releases the uppermost target 11 from the launching head, such that it moves in the positive z-direction along the circumferential cylindrical surface 18' of the cap member 18. During this movement of the target along the surface 18', the radially innermost region 11' of the hub portion of the target 11 is in contact with the surface 18' whereby the target is effectively prevented from wobbling relative to the z-axis.

In the state shown in FIG. 4, the first contact face 16 is radially withdrawn to a position within the interior of the cap member 18 whereas the second contact face 17 of the retaining claw member 15 has contact with the lower target 12 and hence still fixes the lover target 12 to the launching head. A further displacement of the outer body portion 19 relative to the inner body portion 19 will then cause the second contact face 17 of the claw member 15 to pivot to a position in which it is also retracted to a position entirely within the interior of the cap member 18. This state is illustrated in FIG. 5 and results in that the second, lowermost, target 12 is released from fixed contact with the circumferential wall 18' of the cap member 18 and hence moves in the positive direction of the z-axis as described above in relation to the uppermost target 11.

Figure 6:
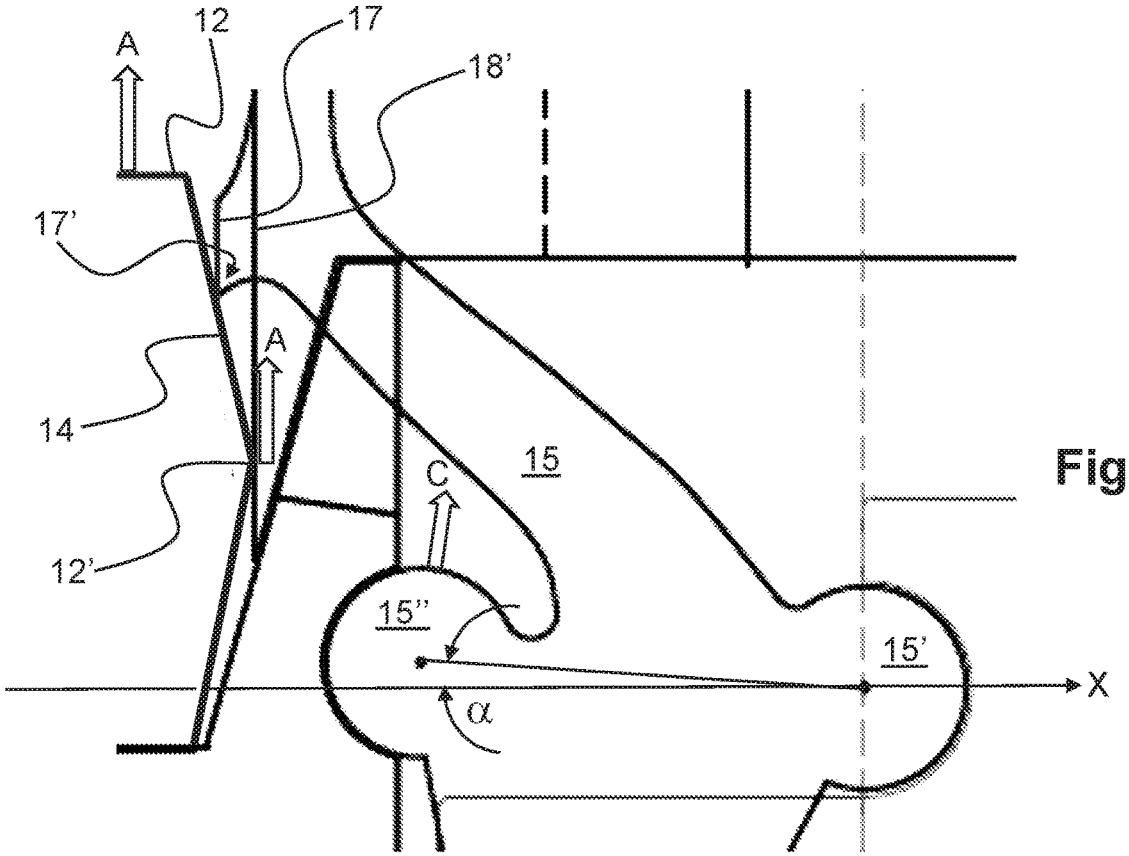
FIG. 6 shows a detailed schematic view of a portion of the embodiment of FIG. 2 showing the retaining claw member in a position in which it has released the upper sports shooting target and still retains the bub portion of the lower sports shooting target to the launching head.

With reference to FIG. 6 there is shown a detailed schematic view of a portion of the embodiment of a launching head according to the invention shown in FIG. 2. FIG. 6 shows the retaining claw member 15 in a position in which it has released the upper sports shooting target 11 and still retains the bub portion 14, 12' of the lower sports shooting target 12 to the launching head. As illustrated in FIG. 6, as the claw member 15 pivots such that the angle α increases (as indicated by arrow C in the figure), the target 12 moves in an upward direction along the circumferential wall 18' of the cap member 18 and the radially innermost portion 12' of the hub portion of the target 12 remains in contact with the circumferential wall 18' during this movement in the positive z-direction, this movement being indicated by arrow A in FIG. 6. Only when the tip portion 17' of the contact face 17 of the claw member 15 is drawn radially into the interion space of the cap member 18, the hub portion 12', 14 of the target 12 is free to leave the launching head 10 in the upward (positive z) direction.

Figure 7:
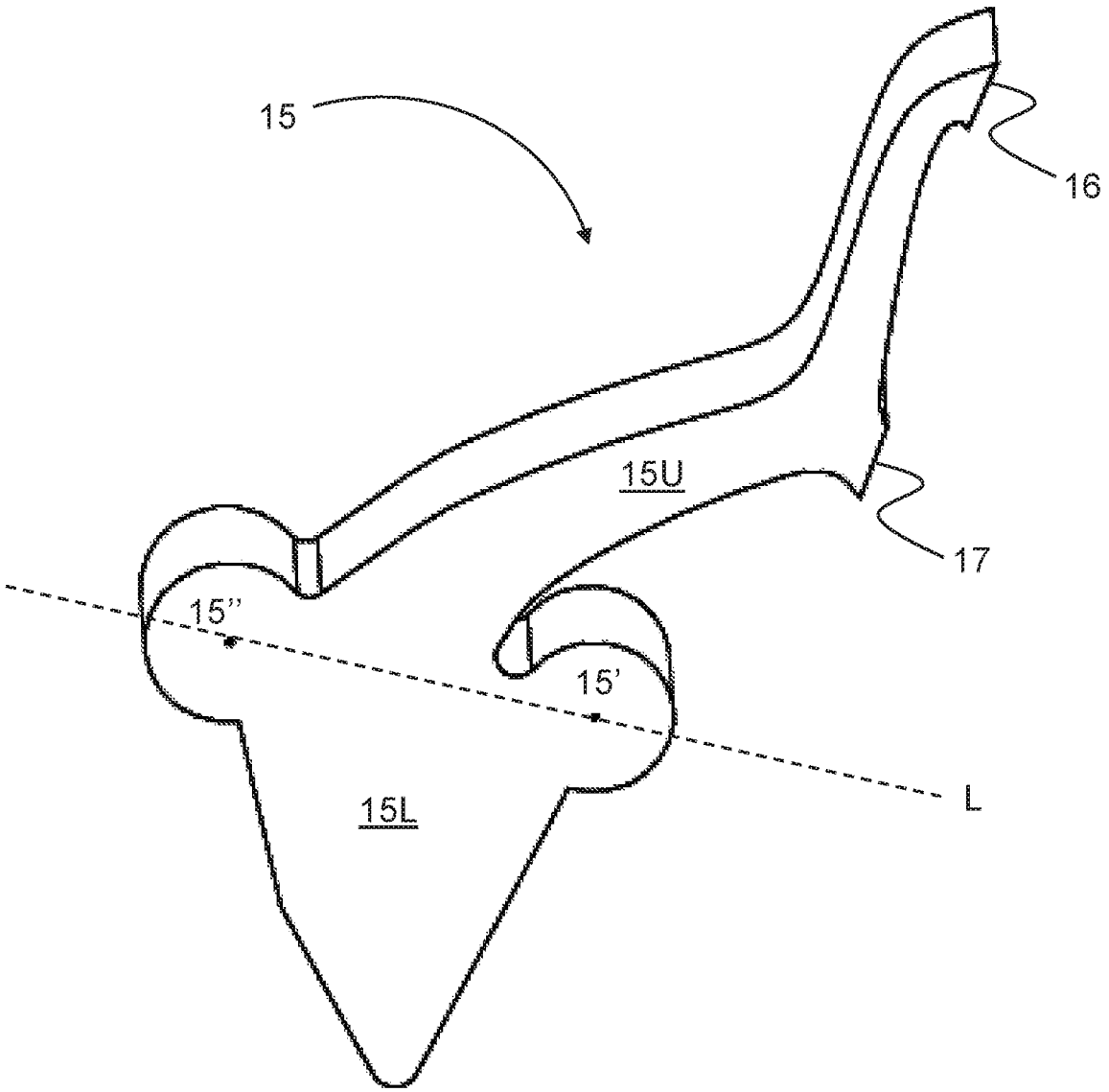
FIG. 7 shows a schematic perspective view of an embodiment of a retaining claw member according to the invention.

With reference to FIG. 7 there is shown a schematic perspective view of an embodiment of a retaining claw member according to the invention generally indicated by 15. It is however understood that other geometrical configurations of the claw member of the invention could also be conceived and that such other configurations would fall within the scope of the claimed invention.

The claw member 15 comprises the first contact face 16 and the second contact face 17 as described previously as well as the two radially extending extensions 15' and 15", respectively. The claw member comprises an upper body portion 15U and a lower body portion 15L separated by line L that extends substantially through the centers of the respective extensions. The geometrical configuration of the claw member 15 is such that the center of gravity of the claw member is located either on the line L or, preferably, slightly below line L, i.e., within the upper portion (as seen in FIG. 7) of the lower body portion 15L. With the center of gravity located below line L, the centrifugal force acting on the claw member when the launching head is rotated at very high rotational speeds about its rotational axis will facilitate release of the targets from the launching head.

Figure 8:
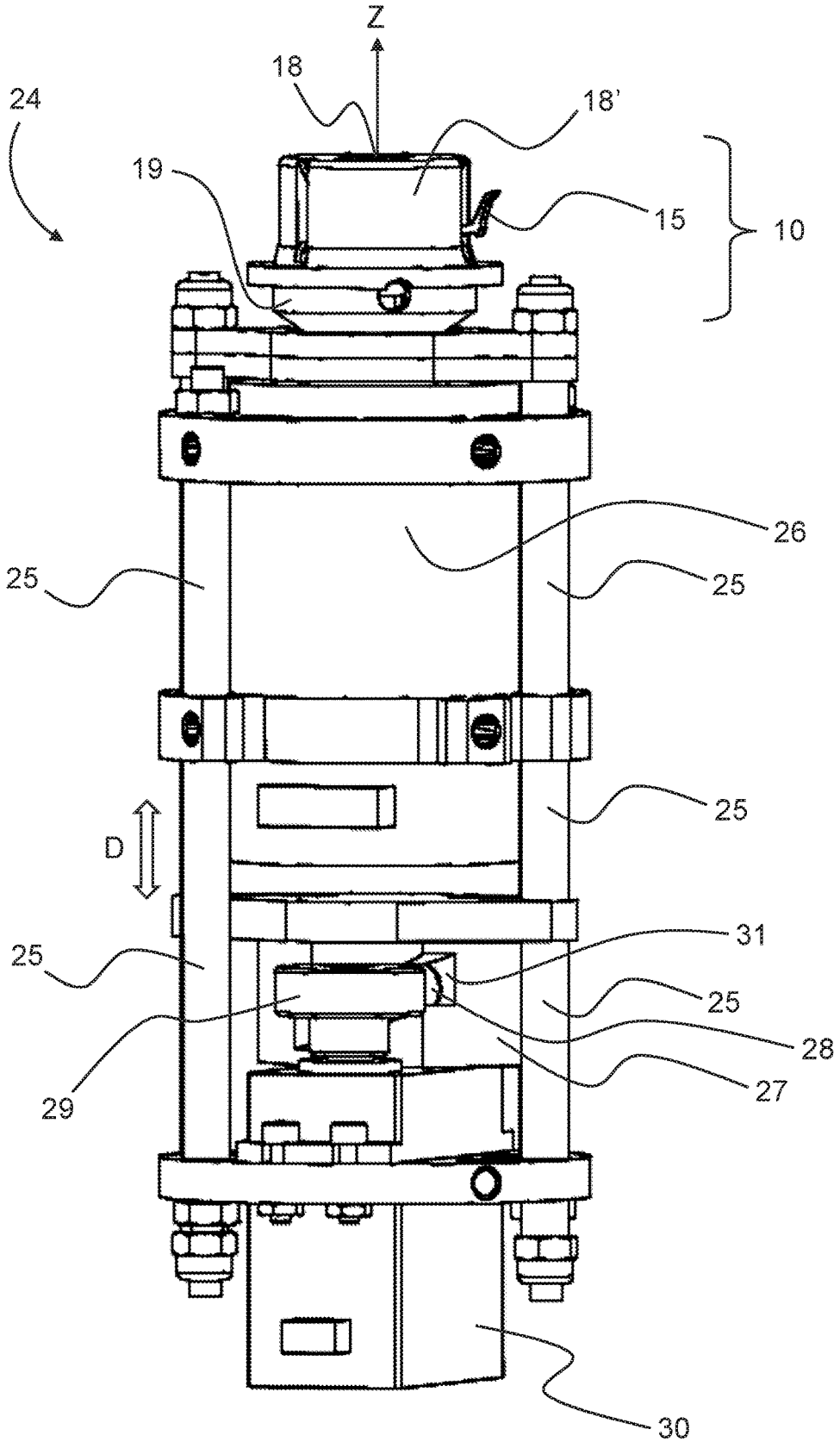
FIG. 8 shows an embodiment of the launching head according to the invention coupled to a mechanism configured to rotate the launching head about its longitudinal axis and to displace an outer body portion of the launching head relative to an inner portion of the launching head and thereby pivoting the retaining claw members.

With reference to FIG. 8 there is shown an embodiment of a launching device according to the invention comprising the launching head 10 according to the invention coupled to a mechanism generally indicated by 24 that is configured to rotate the launching head 10 about its longitudinal axis Z and to displace the outer body portion 19 of the launching head 10 relative to the inner portion 20 (not visible in FIG. 8) of the launching head 10 and thereby pivoting the retaining claw members 15 when the desired final rotational speed of the launching head 10 has been reached that is required for launching of the targets.

Below the launching head (as seen in the figure) a motor 26 that rotates the launching head 10 is provided. At the bottom portion of the device (as seen in the figure) a second motor 30 is provided, the rotational axle of which is connected to a cylindrical member 29 provided with a radially outwardly extending tap member 28. The tap member 28 is in displaceable engagement with an inclined groove 31 provided in a member 27 that is fixed to the longitudinally extending rod member 25. Thus, when the rotational axle of the motor 30 is rotated a given, limited angular distance, the tap member 27 by its engagement with the groove 31 displaces the rod members 25, and hence the outer body portion 19 of the launching head either upwardly or downwardly as indicated by arrow D, depending on the direction of rotation of the rotational axle of the motor 30.

It is pointed out that the displacement mechanism described in FIG. 8 is only one of many possible displacement mechanisms and that the exact choice and layout of such mechanisms is not as such important for the functioning of the invention.

It is however important that the displacement mechanism actually used is configured such that it can provide an initial displacement of the outer body portion 19 of the launching head 10 that releases the first (uppermost) target 11 from the launching head 10 while still retaining the second (lowermost) target 12 to the launching head for a short, predetermined duration of time and then displace the outer body portion 19 of the launching head 10 further, such that the second (lowermost) target 12 is released. The required displacement can either be a continuous function of time or can take place stepwise, if desired.

The displacement means are according to an embodiment of the device configured to displace the outer body portion 20 relative to the inner body portion 19 of the launching head 10 such that the displacement can be preadjusted in such a manner that a given desired time interval between the launching of the first (uppermost) target 11 from the launching head 10 and the launching of the second (lowermost) target 12 from the launching head is obtained.

FIG. 9 shows a perspective vies of a launching head according to an embodiment of the invention comprising three retaining claw members 15, a cap 18 with an outer circumferential surface portion 18' and a support surface for the lowermost target 9'''.

Figure 10A:
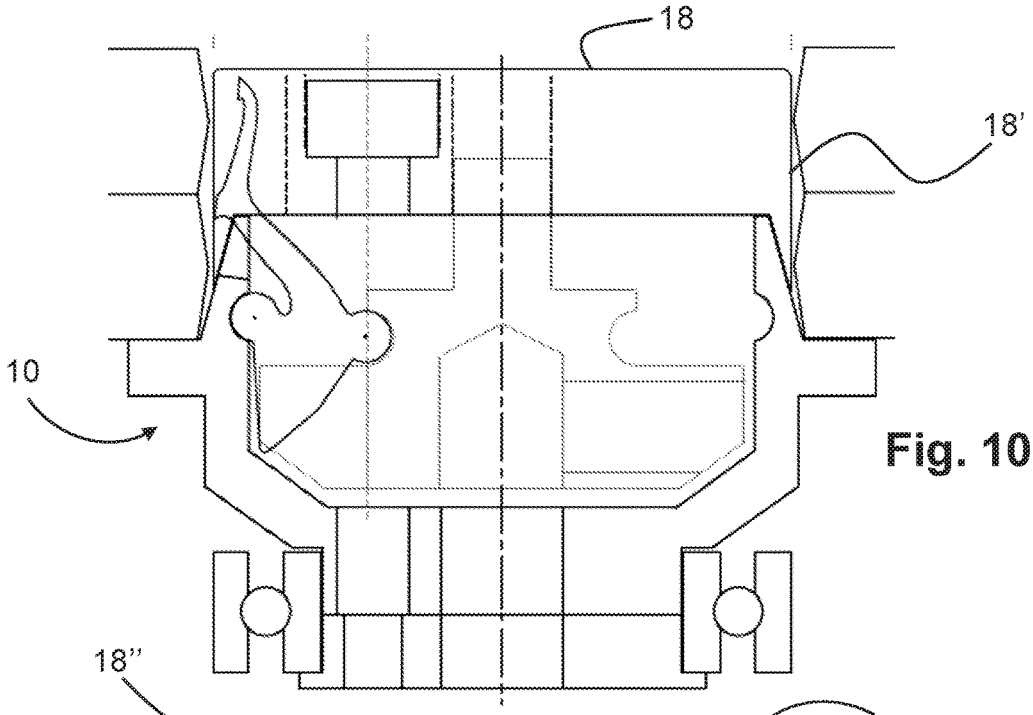
FIGS. 10*a*, 10*b* and 10*c* illustrate details of the cap member provided on top of the launching head according to the embodiment of the invention shown in FIG. 2.
Figure 10B:
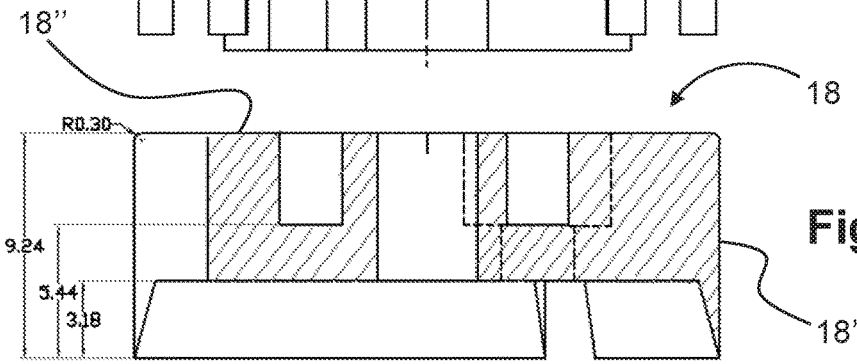
Figure 10C:
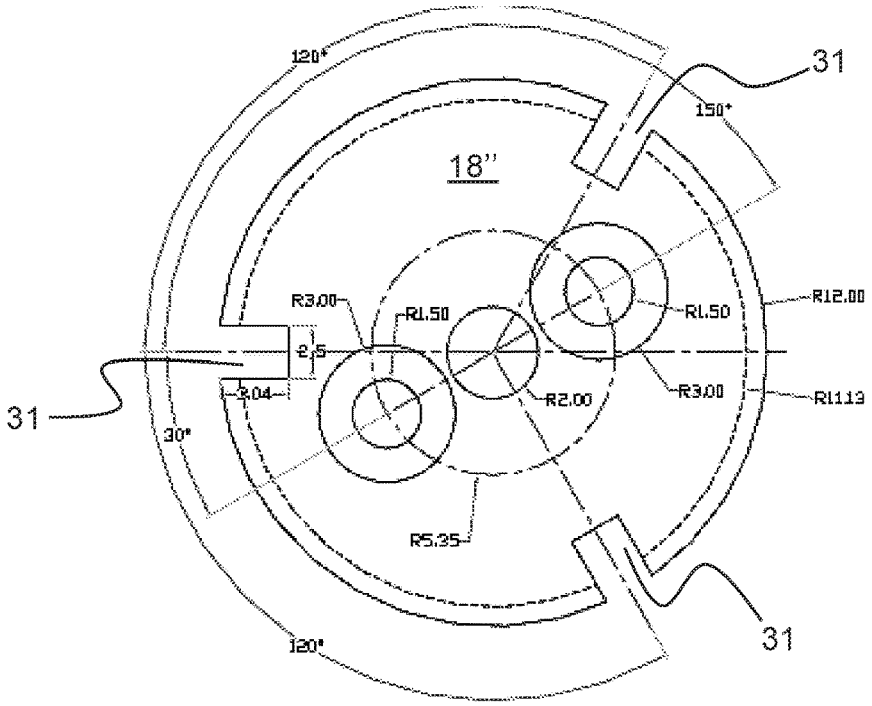

With reference to FIGS. 10*a*, 10*b* and 10*c* there is shown a schematic illustration of some details of the cap member 18 that is provided on top of the launching head 10 according to the embodiment of the invention shown in FIG. 2. FIG. 10*a* is basically identical with FIG. 2 and shows the cap member 18 provided on top of (as seen in the figure) the outer body portion 19 of the launching head 10. FIG. 10*b* shows a longitudinal cross-sectional view through the cap member 18 comprising longitudinally extending slit-formed through openings 24 through which the claw members can pass. Also indicated in FIG. 10*b* are typical dimensions of the cap member, but it is understood that these numerical values are only intended as an example that may serve to illustrate the overall size of a typical embodiment of the cap member and hence—implicitly—of the launching head 10 of this embodiment of the invention.

FIG. 10*c* shows a top view of the cap member 18 with an upper surface 18" illustrating a specific embodiment that comprises three claw members placed at equidistantly along the circumferential surface 18' of the cap member. In other embodiments of a launching head according to the invention a different number of claw members may be used.

With reference to FIGS. 11 and 12 there is shown a schematic representation of a sports shooting target (in the following simply referred to as a "target") according to an embodiment of the invention generally indicated by reference numeral 32.

In the embodiment of the target according to the invention, the target 32 is substantially symmetrical about an (x, y) located centrally in the target, i.e., at approximately equal distances from the "upper" and "lower" end faces 42, 43 of the target, the (x, y) plane extending perpendicularly to the longitudinal rotational axis z as shown in FIG. 12.

The target is defined by a rotational or longitudinal axis z and extends perpendicularly to the (x, y) plane as shown in FIGS. 11 and 12. In the shown embodiment, the target comprises three concentric ring members 35, 36, 37 encompassing a central hub portion 38 surrounding a central space 39. As it is shown in FIG. 11, and more clearly in FIG. 12, the inner circumferential surface of the hub portion 38 comprises two substantially planar and inclined circumferential internal surface portions 33, 34 that are mirror-symmetrical with respect the (x, y) plane. This configuration of the inner circumferential surface of the hub portion 38 makes it possible to apply the target 32 to the launching head from either side of the target as indicated by the arrows B and C in FIG. 12.

Radially extending from the hub portion 38, the target 32 comprises a plurality of trajectory stabilizing and propelling means 40 that together with the ring members 35, 36 and 37 are configured to stabilize the trajectory of the target 32 by gyro effect caused by rotation about the rotational axis z, which stabilizing means further act as propelling means that cause forward movement of the target along its trajectory due to the rotation of the target about the rotational axis z. In the embodiment of the target according to the invention shown in FIGS. 11 and 12 the stabilizing and propelling means comprise fan (or "blade" or "propeller") members 40 consisting of individual fan sections 41 between adjacent ring members 35, 36, 37, which fan or propeller members 40 rotate in unison with the target, such that when the target rotates, the stabilizing and propelling means both provides the stabilizing gyro effect and the forward propulsion/motion of the target along its trajectory.

In FIGS. 11 and 12 the target comprises six fan members 40 (each comprising three fan sections 41), but it is understood that other numbers of fan members or sections could also be used within the scope of the present invention.

The target according to the embodiment shown in FIGS. 11 and 12 comprises a plurality of concentric ring members 35, 36, 37 arranged about the rotational axis z of the target at different distances from the rotational axis z and outside the hub portion 38.

The prime effect of the fan members 40 is to propel the target, i.e., to move it along its trajectory after launching from the launching apparatus. The presence of the ring members 35, 36, 37 enhances visibility of the target, when it is moving along its trajectory through the air after being launched by the launching apparatus as well as increasing the overall rigidity of the target of the invention. The ring members 35, 36, 37 also increases the targets rotational moment of inertia about the rotational axis z, thereby improving the stability of the target in its trajectory that is caused by the gyro effect.

It is understood that although radial distances between the ring members 35, 36, 37 in the embodiment shown in FIGS.

11 and 12 are substantially identical, it is also within the scope of the invention to apply different radial distances between adjacent ring members as well as applying more or less ring members than the three shown in FIGS. 11 and 12.

With reference to FIGS. 12(*a*) and 12(*b*) there is shown a cross sectional view of the embodiment of a target according to the present invention shown in FIG. 11. The embodiment shown in FIGS. 12(*a*) and (*b*) can be attached to the launching head of a launching device from either side as indicated by the arrows B and C, which is a great advantage for instance when a plurality of targets is to be loaded into target containers on a launching apparatus or when the user of the launching head or device loads targets in situ during use of the launching head or device at a sports shooting event. In the embodiment of the target shown in FIGS. 12(*a*) and 12(*b*), the target comprises three concentric ring members 35, 36, 37 and a hub portion 38 provided with inwardly sloping circumferential surfaces 33 and 34 configured for releasable attachment to a corresponding portion 9" of the launching head according to the first aspect of the invention, c.f. FIG. 2. In the shown embodiment, the hub portion 38 is thus substantially symmetrical about the (x, y) plane of the target. The inwardly sloping surfaces 33 and 34 converges towards the (x, y) plane and are of similar extension and slope angle relative to the (x, y) plane, whereby it becomes possible to attach the hob portion 38 of the target to the launching head from either side as indicated by arrows B and C in FIG. 12(*a*). By these features of the hub portion 38, a reversible or "turnable" target is provided.

In order to reduce resistance against the movement of the target along its trajectory by the air through which the target is moving, it is important to design the ring-shaped members 35, 36 and 37 optimally. It has been found that the cross-sectional shape shown in FIG. 12(*b*) yields a good result in that the ring-shaped members by having this cross-sectional shape only impedes the movement of the target along its trajectory minimally. In the shown embodiment, the ring-shaped members comprise curved first and second side faces 35*a* and 35*b*, which side faces meet at either ends 35*c* and 35*d*, respectively, in the z-direction, such that sharp edge portions at the upper and lower edges of the ring-shaped members are formed. The aero-dynamic properties of the ring-shaped members are good due to this shape of the ring-shaped members.

The invention claimed is:

1. A launching head for launching two or more sports shooting targets, where each target is of a generally disc-shaped configuration, where the target is defined by a rotational axis and a central hub portion extending perpendicularly to the rotational axis, the central hub portion comprises a radially inward facing surface formed for releasable attachment of the two or more sports shooting targets to the launching head, where the launching head is characterized in that the launching head is of a generally tubular configuration defined by a longitudinally extending rotational axis and where the launching head is provided with an outer circumferential support surface portion formed to fit into and support said radially inward facing surface of the central hub portion of the respective targets;

the launching head is provided with a plurality of retaining claw members configured to be able to pivot in a plane containing the longitudinally extending rotational axis and pivot an angle relative to a plane extending perpendicularly to the longitudinally extending rotational axis, where each of the plurality of retaining claw members is provided with two longitudinally spaced-apart retaining portions configured such that:

when the retaining claw member is in a first pivotal position, both of the retaining portions are in a radial position outside the outer circumferential support surface portion, in said position both of the retaining portions attach the hub portion of the respective targets to the outer circumferential support surface portion of the launching head, and when the retaining claw member is in a second pivotal position, the retaining portion closest to the pivot point is at a radial position outside the outer circumferential support surface portion, in said position the retaining portion closest to the pivot point attaches the corresponding target to the launching head whereas the other retaining portion is at a radial position inside the support surface portion, in said position the other retaining portion does not attach the corresponding target to the launching head, and when the retaining claw member is in a third pivotal position, both of the retaining portions are in a radial position inside the outer circumferential support surface portion where both of the retaining portions do not attach the respective target to the outer circumferential support surface portion of the launching head.

2. A launching head according to claim 1, wherein the outer circumferential support surface portion extends in parallel with the longitudinally extending rotational axis thereby forming a cylindrical support surface portion about the longitudinally extending rotational axis configured to guide and support the targets during launching from the launching head.

3. A launching head according to claim 1, wherein the outer circumferential support surface portion is formed by an outer circumferential surface of a cap member, wherein the cap member is provided at a longitudinal end portion of an outer body portion that faces in a positive direction of the longitudinal rotational axis.

4. A launching head according to claim 1, further comprising an inner body portion and an outer body portion that can undergo a longitudinal displacement relative to the inner body portion, where the retaining claw members are in engagement with the inner body portion and the outer body portion such that said displacement causes the retaining claw members to pivot in a plane containing the longitudinally extending rotational axis between said first, second and third pivotal positions.

5. A launching head according to claim 4, wherein said retaining claw members each comprises two retaining contact portions configured to establish contact with and retain a respective target to the launching head.

6. A launching head according to claim 5, wherein each of the retaining claw members comprises extensions, where one extension is configured to fit into a corresponding circumferentially extending groove provided in the inner body portion and a second extension of the retaining claw member is configured to fit into a corresponding groove on an inner surface portion of the outer body portion, whereby a longitudinal displacement of the outer body portion relative to the inner body portion causes the retaining claw member to pivot an angle in a plane comprising the longitudinal rotational axis of the launching head.

7. A launching head according to claim 6, wherein each of the retaining claw members is divided in an upper body portion and a lower body portion separated by a line that extends substantially through a center portion of the extensions of the retaining claw member and where a geometrical configuration of the retaining claw member is such that a center of gravity of the retaining claw member is located either on a line L or within the lower body portion of the retaining claw member.

8. A launching device comprising a launching head according to claim 4, where the launching device comprises displacement means configured to displace said outer body portion relative to said inner body portion of the launching head such that the displacement can be preadjusted in such a manner that a given desired time interval between a launching of the first target from the launching head and a launching of the second target from the launching head is obtained.

9. A launching device according to claim 8, wherein said displacement means comprises longitudinally extending rod members that connects the outer body portion of the launching head with displacement drive means configured to provide such a displacement of the outer body portion that is required to pivot the retaining claw members from one extreme position in which the two or more sports shooting targets are retained to the launching head, and hence rotates in unison with the launching head to an opposite extreme position in which the two or more sports shooting targets are released from the launching head.

10. A sports shooting target for application with the launching head according to claim 9, where the sports shooting target is made of a biodegradable material, the sports shooting target having a rotational axis and attachment means configured for releasable attachment of the sports shooting target to the launching head, where the sports shooting target is provided with trajectory stabilizing means that are configured to stabilize a trajectory of the sports shooting target by gyro effect caused by rotation about said rotational axis which stabilizing means further function as propelling means that cause forward movement of the sports shooting target along the trajectory of the sports shooting target due to the rotation about said rotational axis, when the sports shooting target is rotating, where said stabilizing means comprises fan means comprising fan blades that rotates in unison with the sports shooting target, when the sports shooting target rotates, such that the stabilizing means both provides said stabilizing gyro effect and forward propulsion or movement of the sports shooting target along a chosen trajectory; where:

the sports shooting target comprises a hub portion configured for releasable attachment to a corresponding portion of the launching head, said portion of the launching head, when the sports shooting target is attached thereto, can rotate said sports shooting target and release said sports shooting target from the launching head, when a desired terminal rotational speed has been reached; and the hub portion is provided with an inner circumferential surface facilitating release of the sports shooting target from said portion of the launching head and which surface defines an inner space;

the sports shooting target comprises a plurality of concentric ring members arranged about the rotational axis of the sports shooting target at different distances from the rotational axis and outside the hub portion;

the stabilizing means comprises a plurality of fan blades that extend radially from the hub portion to the ring member provided at a largest distance from the rotational axis; and where the hub portion comprises inwardly sloping surfaces that converge towards the longitudinal rotational axis of the sports shooting target, where the inwardly sloping surfaces of the hub portion are substantially mirror-symmetrical about a plane extending centrally through the sports shooting target and perpendicularly to the rotational axis of the sports shooting target, whereby it becomes possible to attach the hub portion of the sports shooting target to the launching head from either side of the sports shooting target.

11. A sports shooting target according to claim 10, where said ring members have cross-sectional shapes comprising curved first and second side faces, where the first and second side faces meet at a substantially sharp edge portion, thereby optimizing aero-dynamic properties of the respective ring members.

12. A sports shooting target according to claim 10, where an inclination angle of the ring members relative to the plane of the target increases towards the hub portion.

13. A launching device according to claim 8, wherein said displacement means are configured and controlled such that said displacement is continuous.

14. A launching device according to claim 8, wherein said displacement means are configured and controlled such that said displacement is stepwise.

15. A launching head according to claim 1, wherein the longitudinally spaced-apart retaining portions of the claw member have contact faces that correspond to a corresponding inner circumferential surface of the hub portion of the corresponding target.

* * * * *